United States Patent [19]

Saro

[11] Patent Number: 4,941,625

[45] Date of Patent: Jul. 17, 1990

[54] CREEL FOR THE SIMULTANEOUS CHANGING OF REELS OF METALLIC WIRE

[75] Inventor: Giancarlo Saro, Ceresetto Di Martignacco, Italy

[73] Assignee: Impianti Industriali SpA, Osoppo, Italy

[21] Appl. No.: 208,036

[22] Filed: Jun. 17, 1988

[30] Foreign Application Priority Data

Jul. 3, 1987 [IT] Italy ..... 83400 A/87

[51] Int. Cl.[5] ..... B65H 49/20; B65H 67/00

[52] U.S. Cl. ..... 242/131; 242/25 R; 242/129.6

[58] Field of Search ..... 242/131, 131.1, 129.5, 242/129.51, 129.6, 129.62, 54 R, 68.4, 58, 25 R, 35.5 R, 85

[56] References Cited

U.S. PATENT DOCUMENTS

| | | | |
|---|---|---|---|
| 2,332,005 | 10/1943 | Nystrom et al. | 242/131 |
| 2,544,348 | 3/1951 | Nystrom | 242/129.6 |
| 3,195,832 | 7/1965 | Kirchmeyer et al. | 242/129.6 |
| 3,371,878 | 3/1968 | Garner | 242/131 X |
| 3,584,808 | 6/1971 | Staples et al. | 242/68.4 |
| 3,897,914 | 8/1975 | McCarthy et al. | 242/129.6 |
| 4,098,468 | 7/1978 | Skallberg | 242/54 R |
| 4,265,411 | 5/1981 | Fasolak | 242/68.4 X |
| 4,365,768 | 12/1982 | Woodruff | 242/68.4 X |
| 4,470,012 | 5/1984 | Woodruff | 242/54 R |
| 4,629,143 | 12/1986 | Griffin | 242/131 |
| 4,718,817 | 1/1988 | Maillefer | 242/54 R X |

FOREIGN PATENT DOCUMENTS

| | | |
|---|---|---|
| 738012 | 2/1970 | Belgium . |
| 2634564 | 2/1978 | Fed. Rep. of Germany . |

OTHER PUBLICATIONS

Patent Abstracts of Japan, vol. 7, No. 47 (M-196)[1192], Feb. 24, 1983; and JP-A-57 195 067 (Hitachi Densen K.K.) Nov. 30, 1982.

*Primary Examiner*—Stanley N. Gilreath
*Attorney, Agent, or Firm*—Wegner & Bretschneider

[57] ABSTRACT

Creel (10) for the simultaneous changing of reels (13) of metallic wire (14), cooperating with machines in the production of metallic mesh, advantageously electrically welded mesh, the machines being located downstream of the creel (10) and being fed with a plurality of metallic wires (14), the creel (10) comprising a structure (11) with a first (15) and second (16) parallel tiers of which one is superimposed on the other and on which are positioned respectively equal numbers of units (12-112) that support the reels (13), the support units (12-112) for the reels (13) consisting of a portion (17) fixed to the structure (11) and a portion (23) movable in relation to the structure (11).

14 Claims, 6 Drawing Sheets

CREEL FOR THE SIMULTANEOUS CHANGING OF REELS OF METALLIC WIRE

Figure 1:
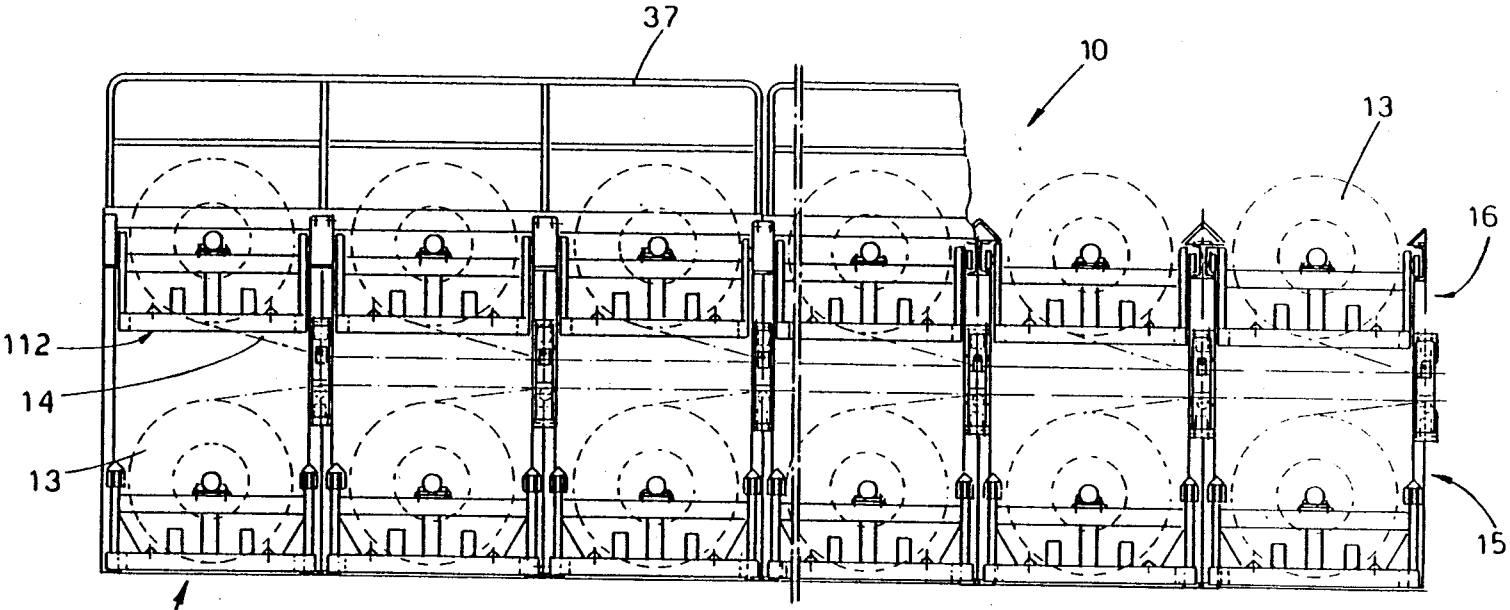

This invention concerns a creel for the simultaneous changing of reels of metallic wire, cooperating with machines in the production of metallic mesh, the machines being located downstream of the creel and being fed with metallic wires. To be more exact, the invention concerns a creel for simultaneous changing of reels which is suitable to feed machines for the production of electrically welded metallic mesh.

The creel according to the invention comprises also devices suitable to cooperate with machines producing electrically welded mesh in the correct unwinding of the reels.

Creels are known which are positioned to feed machines producing metallic mesh. These creels hold a plurality of reels of metallic wire suitable for the characteristics of the mesh to be produced and of the production machine which makes the mesh.

The reels are all positioned on one tier and are arranged in a plurality of rows on the creel, each row consisting of at least two reels. The reels feed simultaneously the mesh production machine positioned downstream.

The change of empty reels takes place with a random method, this is to say, the change takes place by replacing individual empty reels whenever necessary in a succession which cannot be pre-arranged.

Under such conditions the mesh production machine is halted to await replacement with a new reel. The handling of the full and empty reels is carried out with suitable lifting and positioning means.

This kind of creels includes a structure to support reels with immovable elements that uphold each reel individually.

Such elements may cooperate with the reel by merely supporting it; in this case the reel will be equipped with axial pins rigidly connected to the flanges of the reel.

Otherwise, the elements may also comprise fixed support and alignment means such as tailstocks for instance; in such a case the central body of the reel on which the wire is wound will be equipped terminally with means able to rotate, such as ball bearings.

These creels entail a plurality of shortcomings. A first shortcoming is that the random method of replacing the reels on the creel involves frequent downtimes of the mesh production machines with a resulting decrease in their output.

Moreover, the period of each downtime is very long since access to each reel to be replaced is made hard owing to the presence of the other wires passing towards the production machine.

A further drawback is that the known creels do not include means to control the unwinding of the reel during downtimes of the production machine. This entails an extra undesired unwinding of lengths of wire from the reels, accompanied by an accentuation of the problems of replacement of the reels on the creel and the re-starting of the production machine.

Moreover, cooperation between creel and reel by mere support indeed enables structurally simple reels to be employed but does not enable the wire to be unwound in a regular manner.

Furthermore, reels which cooperate in this way create storage problems owing to the inclusion of the pins protruding axially from the flanges of the reels.

Where the creels have support means cooperating with rotatable elements on the reels, regular unwinding of the wire is ensured but it becomes necessary to employ structurally complex and therefore expensive reels.

Document U.S.-A-3,897,914 discloses an apparatus for unreeling wire rope, in which bobbins are firstly journaled upon especially designed fork lift pallets and stored in unreeling position upon especially designed structural racks.

Document JP-A-57-195067 discloses a skid device for unreeling wire rope from bobbins which are positioned on horizontal shafts of a bobbin rack.

Document BE-A-738012 discloses a bobbin rack comprising a chain conveyor acting on an horizontal plane and provided with horizontal bobbin supporting shafts.

Document DE-A-2,634,564 discloses a creel for supporting bobbins comprising a vertical supporting bar provided with a plurality of slightly inclined bobbin supporting shafts, said vertical bar being movable by means of a crane and being able to be journaled to a fixed rack.

Document US-A-2,332,005 discloses a bobbin handling apparatus, comprising bobbin transporting and journaling means, and means for unreeling the wire rope wound on said bobbins.

The bobbin handling apparatus is provided with a plurality of motors able to rotatably drive said bobbins; furthermore, said apparatus features a slightly inclined plane allowing a comfortable transport of the bobbins towards the wire rope unreeling stations.

The bobbins are journaled to the motor shafts by means of manually operated tailstocks.

The present applicant has designed, tested and embodied a creel able to overcome all the drawbacks of the prior art.

This is achieved by means of a creel of the type mentioned above, and having the features wherein support units for reels consist of a portion fixed to the structure and a portion movable in relation to the structure.

Preferred embodiments and advantageous forms of the invention are described in the following.

The creel according to the invention comprises a structure with two parallel tiers, one superimposed on the other, for the unwinding of reels.

Units to support the reels are included in each tier and are arranged in a modular manner, one after another in the direction of the lengthwise extent of the creel.

These units, which are arranged in two tiers in advantageously equal numbers, occupy coinciding vertical positions on the respective tiers when it is desired to restrict the lengthwise extent of the creel; otherwise they can take up staggered positions.

The reels are positioned on the support units with their axis of rotation perpendicular to the lengthwise axis of the creel.

The number of units and therefore of reels in each tier depends on the characteristics of the production machine positioned downstream of the creel.

Each support unit consists of a stationary part solidly fixed to the structure of the creel and of a part able to move crosswise to the lengthwise axis of the creel.

The stationary and movable parts comprise rotary elements to align and support the reel to be unwound. At least one of such rotary elements cooperates with means that brake the reel.

The brake means of all the support units on one tier work independently of those of the support units on the other tier.

During unwinding, the stationary and movable parts cooperate in forming a rigid assembly to support a reel.

When a reel is being changed, the movable part is driven laterally to free the reel from the rotary alignment elements and itself becomes a means to support the reel thus freed.

The movable part of the support units in the lower tier of the creel carries out a supplementary lateral movement outside the overall bulk formed by the corresponding units of the upper tier. In this way there is free access for known lifting and positioning means to approach a reel to be replaced.

Lateral movement of the movable part is actuated by hand by the machine operator on each support unit.

According to a variant the lateral movement of the movable parts of each tier can be actuated automatically in a sequence which can be programmed.

Each support unit cooperates with means that control and guide the wire being unwound from the respective reel. These means controlling and guiding the wire are readily accessible from outside the creel during the operations of changing the reel and passing the wire to the production machine.

The above disclosure shows clearly that the invention concerns a creel suitable to feed a mesh production machine alternately from reels arranged on the lower tier of the creel and from reels on the upper tier.

It is possible in this way to obtain an automatic replacement of all the reels, that is a simultaneous replacement on exchange or a non-stop replacement on exchange, the so-called "American replacement", by changing all the empty or almost empty reels of one tier.

The step of replacement of the reels of one tier takes place after the start-up of unwinding of all the reels of the other tier, which were arranged beforehand to form a reserve.

The downtimes of the mesh production machine are considerably reduced in this way. Ready access to the support units reduces the individual times for intervention still further.

The inclusion of the means to brake the reels enables the replacements of reels to be performed without any contact between the wires, which would otherwise occur with a plurality of wires being unwound.

Moreover, the rotary alignment elements of the support units enable reels to be employed which are structurally simple, inexpensive and easy to store, even in layers superimposed on each other.

According to a variant the creel comprises two working sides on each of the two tiers, the sides being positioned symmetrically in relation to the centre line of the creel.

Figure 3:
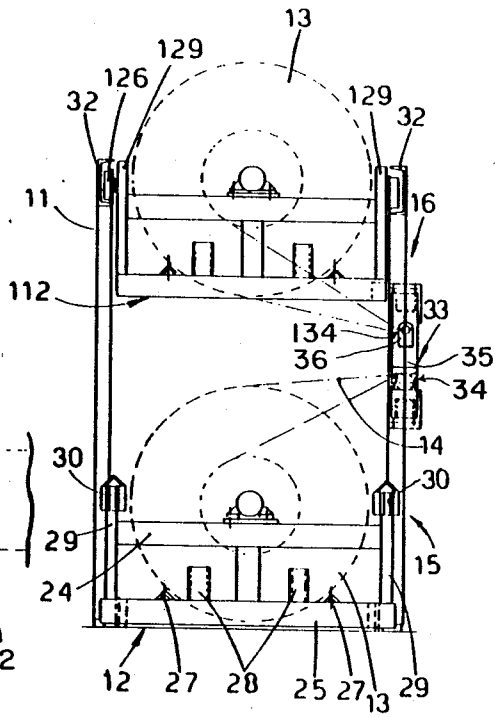
Figure 2:
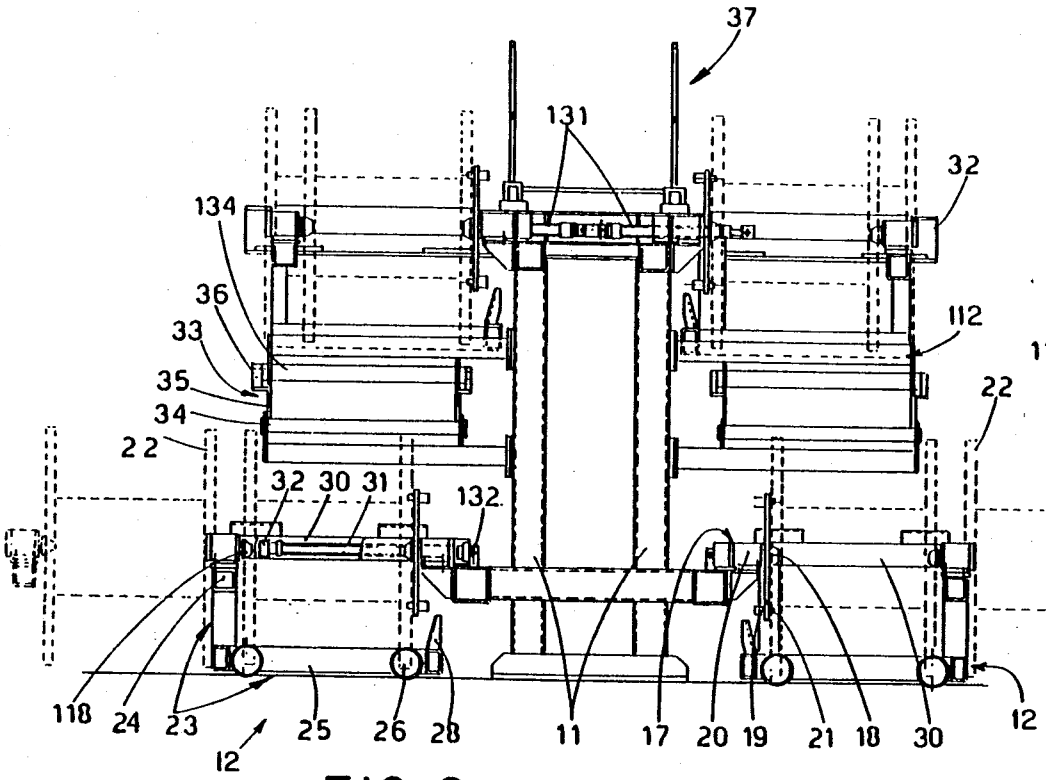
Figure 4:
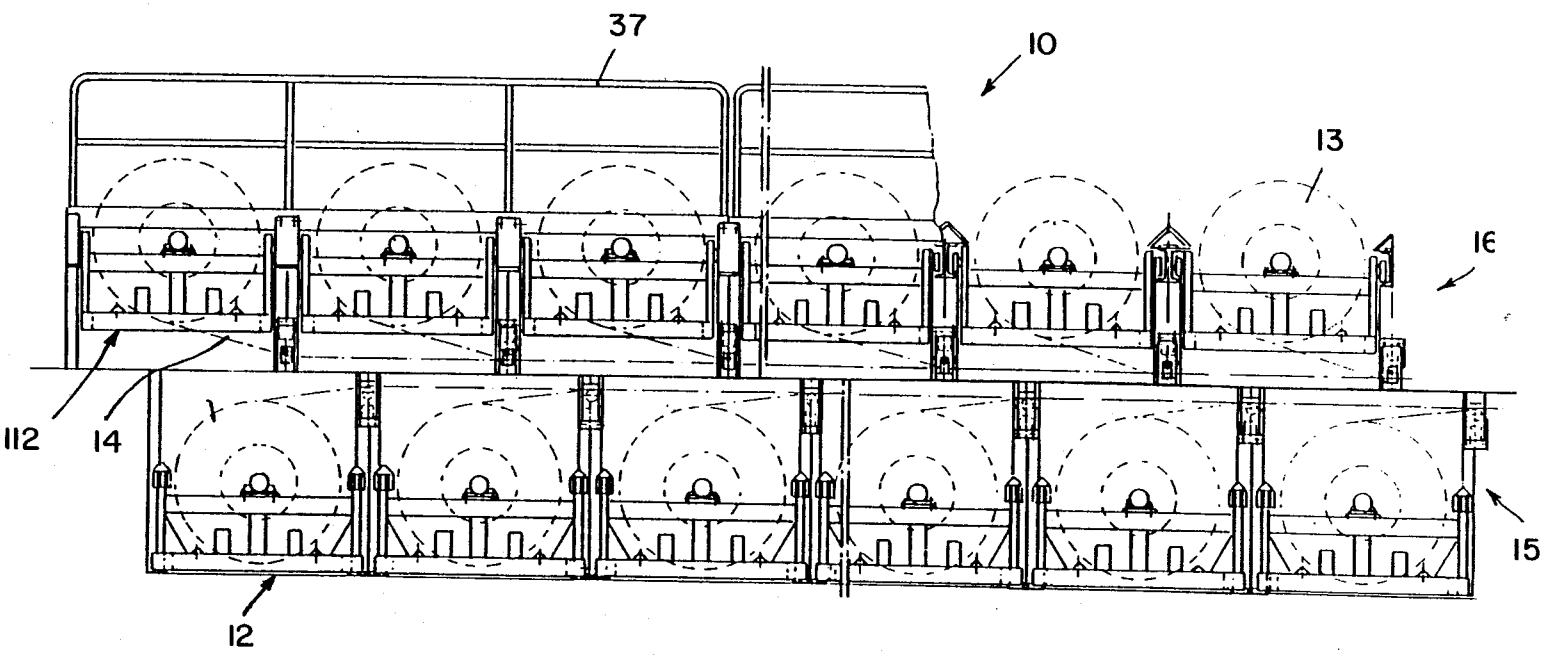

The attached figures, which are given as a non-restrictive example, show the following:

FIG. 1 gives a side view of an embodiment of a creel according to the invention;

FIG. 2 gives a front view of a creel with two working sides according to a variant of the invention;

FIG. 3 gives an enlarged side view of two reel support units, one superimposed on the other;

FIG. 4 gives a front view of a creel where the support units of one tier are staggered with respect to those of the other tier according to another embodiment.

Figure 5:
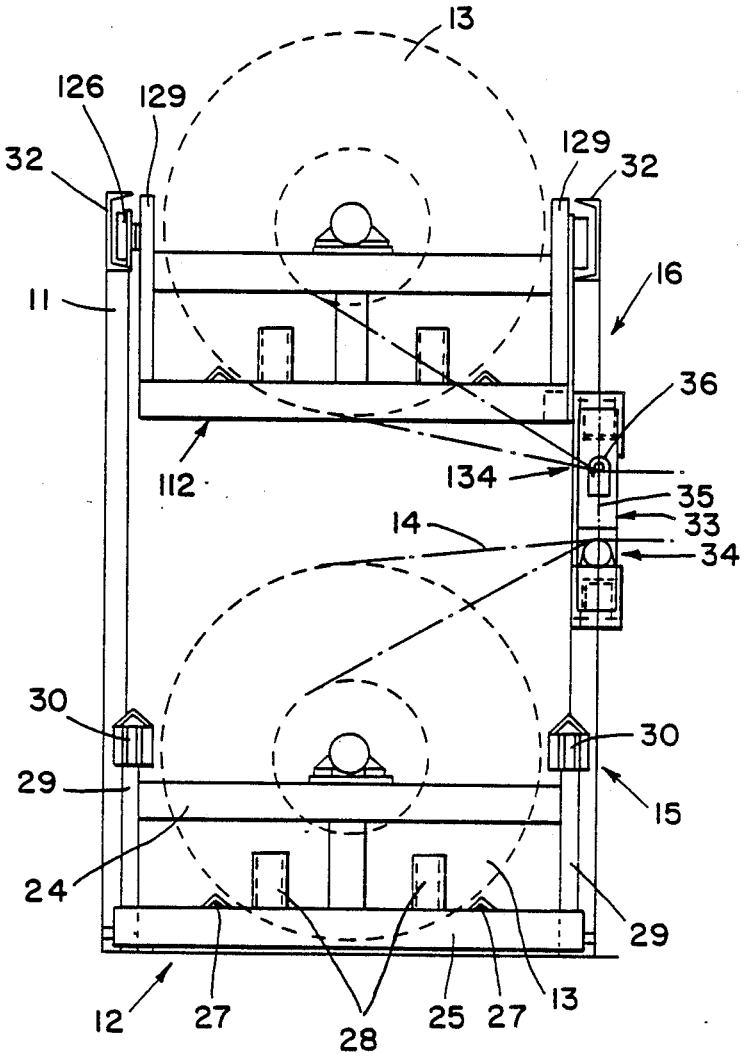
Figure 6:
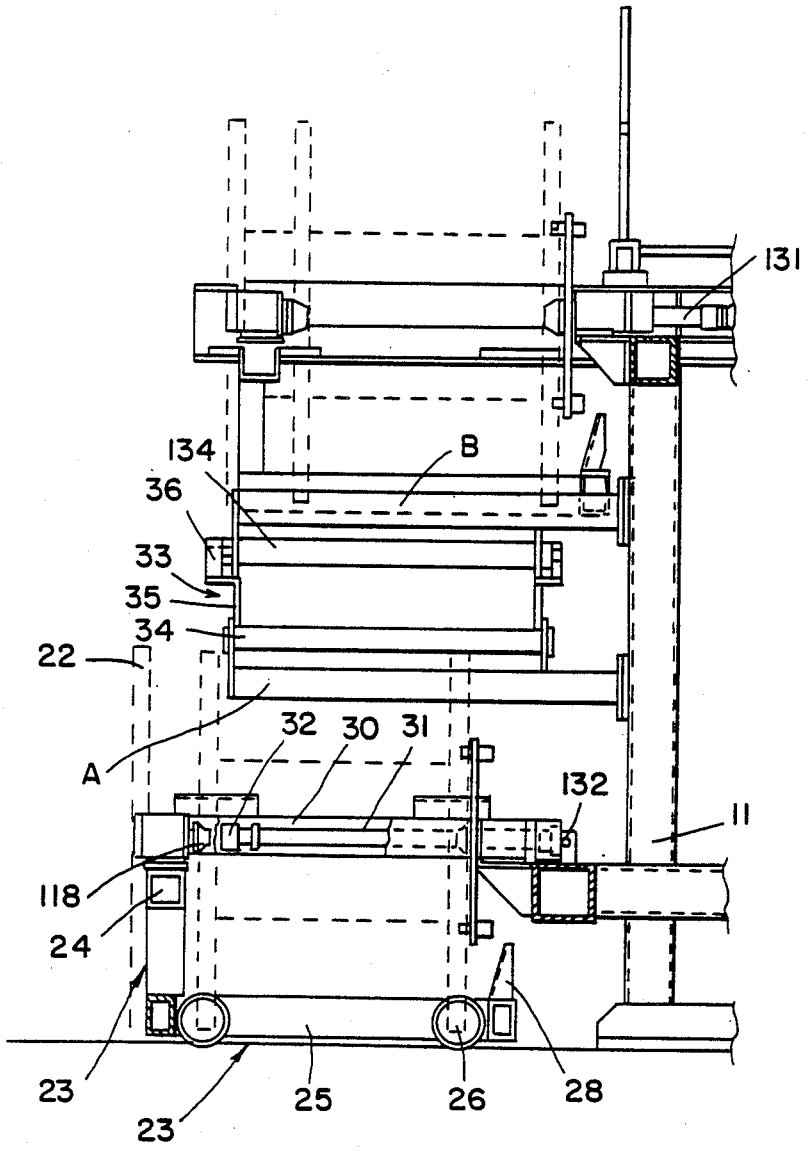

FIGS. 5 and 6 show enlarged portions of FIGS. 2 and 3, respectively.

Figure 7:
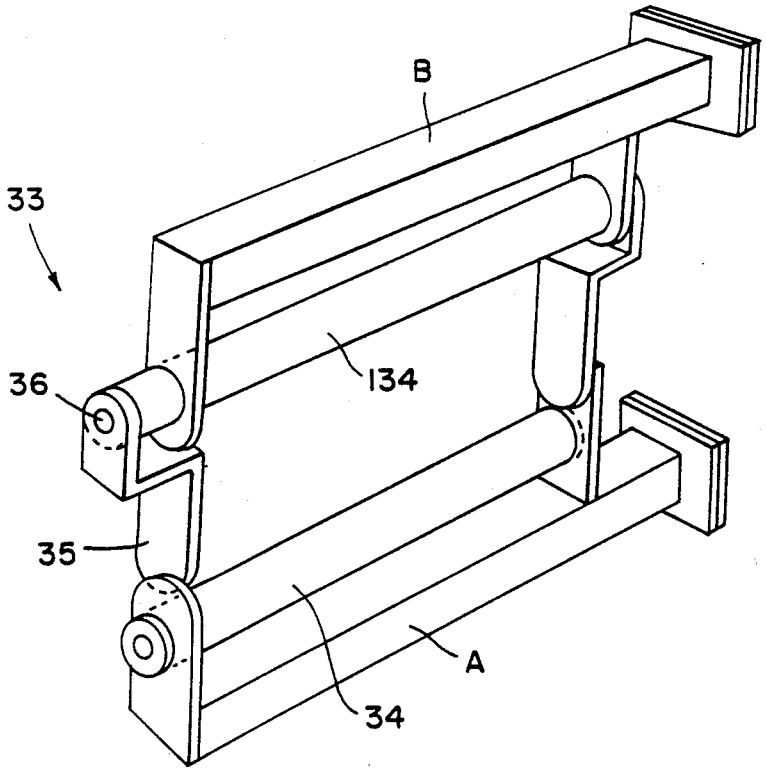

FIG. 7 is a three-dimensional detail of assembly 33 showing rollers 34 and 134, shields 35 and pivots 36, and supports A and B.

A creel 10 comprises a structure 11 arranged in a modular manner to uphold support units 12 and 112 which support reels 13 of wire 14.

The support units 12 are positioned in a lengthwise sequence on a first lower tier 15 of the creel 10, whereas the support units 112 are positioned in the same way on a second higher tier 16 parallel to and superimposed on the first tier 15.

The lower support units 12 consist firstly of a fixed portion 17 solidly connected to the structure 11. This fixed portion 17 consists of a first tailstock 18 to hold the reel 13, such tailstock 18 being substantially shaped as a truncated cone and being able to rotate freely on ball bearings.

The fixed portion 17 comprises also a clamp 19 solidly fixed to the first tailstock 18 and a brake 20. The clamp 19 is equipped with catches 21 which cooperate with radial ribs on flanges 22 of the reels 13.

The clamp 19 is able, together with the brake 20, to halt the reel 13.

The support units 12 consist also of a movable portion 23 formed substantially like a trolley open on its side towards the fixed portion 17.

The movable portion 23 comprises an element 24 which supports a second tailstock 118 coaxial with the first tailstock 18 and able to rotate freely on ball bearings.

A base 25 of the movable portion 23 is equipped with wheels 26 that cooperate with guides in the floor (not shown in the figures).

Seatings 27 for reels 13 freed from the tailstocks 18–118 are positioned on the base 25.

Safety abutments 28 for lateral control of the reels 13 are shown.

Tubular stringers 30 are rigidly connected to uprights 29 of the movable portion 23. A jack 31 is positioned within each tubular stringer 30 and is connected terminally at 32 and 132 to the stringer 30 and stationary structure 11 respectively.

The action of each jack 31 positions the movable portion 23 for the change of a reel 13 as shown with lines of dashes in FIG. 2.

The empty reel 13 is lifted with suitable means from the seating 27, on which a new full reel is then positioned. Thereafter, the jack 31 returns the movable portion 23 to its unwinding position.

The conformation of the tailstocks 18–118 in cooperation with the seating 27 is such that the new reel 13 is positioned automatically between the tailstocks 18–118 when the movable portion 23 reaches its working position.

The upper support units 112 of the second tier 16 are conformed substantially like the corresponding lower support units 12 of the first tier 15.

Wheels 126 of the upper support units 112 run in guides 32 solidly fixed to the structure 11.

Upper uprights 129 connected to these wheels 126 are actuated by upper jacks 131 having functions equivalent to those of the jacks 31 of the lower tier 15.

The extent of the lateral movement of the movable portion 23 of the upper units 112 is such that it corresponds to the extent of the release of the reel 13 by the tailstocks 18–118 as shown with lines of dashes in FIG. 2.

Suitable upper lifting and positioning means can take required action as in the case of the lower units 12, while an assembly 33 to control and guide the wire is also shown and consists of rollers 34 and 134 solidly connected to the structure 11.

The roller 34 guides the wires 14 coming from the reels 13 of the lower tier 15, whereas the roller 134 guides the wires coming from the reels 13 of the upper tier 16. The rollers 34, 134 comprise terminal shields 35 able to oscillate on pivots 36 in the direction of feed of the wires 14. This arrangement is illustrted in FIGS. 2 and 3.

Such shields 35 form a lateral guide for the wires 14 and by means of their oscillation enable the wires to be swiftly and easily inserted during the operations of replacement of reels 13.

Means 37 to provide access for the machine operators for inspection purposes may be included in the variant of FIG. 2 with two working sides.

I claim:

1. Creel for simultaneous changing of reels of metallic wire for cooperating with metallic mesh production machines, comprising:

a structure including a first lower tier and a second upper tier, said second upper tier parallel to and superimposed on said first lower tier;

a plurality of lower support units for supporting reels of wire, positioned in a lengthwise sequence on said first lower tier; and a plurality of upper support units for supporting reels of wire, positioned in a similar manner as said lower support units in a lengthwise sequence on said second upper tier, the number of the upper support units equal to the number of the lower support units;

said upper support units and said lower support units each comprising a fixed portion fixedly connected to said structure and a movable portion for moving crosswise to the lengthwise direction of the structure.

2. Creel as recited in claim 1, wherein said fixed portions and said movable portions of the upper and lower support units include means cooperating together to form a rigid system to support reels during unwinding.

3. Creel as recited in claim 1, wherein said movable portions of the upper and lower support units include means for carrying out displacements of an extent differentiated as between said lower support units and said upper support units.

4. Creel as recited in claim 1, wherein said fixed portions and said movable portions of the upper and lower support units include rotary elements for aligning and supporting the reels.

5. Creel as recited in claim 4, further including at least one means for braking a reel functionally cooperating with one of said rotary elements.

6. Creel as recited in claim 4, further including at least one means for braking a reel on the upper tier functionally cooperating with one of said rotary elements, and at least one means for braking a reel on the lower tier functionally cooperating with one of said rotary elements and working independently of said means for braking on the upper tier.

7. Creel as recited in claim 1, wherein said movable portions of said upper and lower support units include means to seat the reels.

8. Creel as recited in claim 1, further comprising means for controlling and guiding wire, functionally cooperating with said upper support units and said lower support units.

9. Creel as recited in claim 8, wherein said means for controlling and guiding wire include shields for oscillating in the direction of feed of the wires and for forming a lateral guide for the wire.

10. Creel as recited in claim 9, wherein said means for controlling and guiding wire further includes rollers for guiding the wire coming from the reels.

11. Creel as recited in claim 1, further comprising jack means for positioning said movable portions in a reel-changing position or a reel-unwinding position.

12. Creel as recited in claim 1, wherein said structure includes two working sides on each said upper and lower tier, said sides being positioned symmetrically in relation to the lengthwise median plane of the structure.

13. Creel as recited in claim 1, wherein said lower support units and said upper support units occupy coinciding vertical positions on the lower and upper tiers, respectively.

14. Creel as recited in claim 1, wherein said lower support units and said upper support units occupy vertical positions staggered in relation to each other on said lower and upper tiers, respectively.

* * * * *